US006932719B2

(12) United States Patent
Yabu

(10) Patent No.: US 6,932,719 B2
(45) Date of Patent: Aug. 23, 2005

(54) GOLF CLUB HEAD AND GOLF CLUB

(75) Inventor: Masanori Yabu, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/762,283

(22) Filed: Jan. 23, 2004

(65) Prior Publication Data

US 2004/0152539 A1 Aug. 5, 2004

(30) Foreign Application Priority Data

Feb. 4, 2003 (JP) ..... 2003-027430

(51) Int. Cl.[7] ..... A63B 53/04
(52) U.S. Cl. ..... 473/345; 473/346; 473/349
(58) Field of Search ..... 473/324–350, 473/290–291

(56) References Cited

U.S. PATENT DOCUMENTS

| | | | | | |
|---|---|---|---|---|---|
| 5,205,560 | A | | 4/1993 | Hoshi et al. | |
| 5,242,168 | A | * | 9/1993 | Aizawa | 473/332 |
| 5,316,298 | A | * | 5/1994 | Hutin et al. | 473/332 |
| 5,497,993 | A | * | 3/1996 | Shan | 473/329 |
| 5,669,827 | A | * | 9/1997 | Nagamoto | 473/345 |
| 5,766,091 | A | * | 6/1998 | Humphrey et al. | 473/324 |
| 5,766,094 | A | * | 6/1998 | Mahaffey et al. | 473/342 |
| 5,839,975 | A | * | 11/1998 | Lundberg | 473/346 |
| 5,921,872 | A | | 7/1999 | Kobayashi | |
| 5,997,415 | A | * | 12/1999 | Wood | 473/346 |
| 6,443,854 | B1 | * | 9/2002 | Calboreanu | 473/324 |
| 6,648,774 | B1 | * | 11/2003 | Lee | 473/342 |
| 6,776,725 | B1 | * | 8/2004 | Miura et al. | 473/327 |

FOREIGN PATENT DOCUMENTS

| | | | |
|---|---|---|---|
| JP | 4-135576 | A | 5/1992 |
| JP | 07-98076 | B2 | 10/1995 |
| JP | 11-155981 | A | 6/1999 |
| JP | 3063897 | U | 9/1999 |

* cited by examiner

*Primary Examiner*—Sebastiano Passaniti
(74) *Attorney, Agent, or Firm*—Birch, Stewart, Kolasch & Birch, LLP

(57) ABSTRACT

A head (5) comprises a body (9), a face (11), a neck (13) and a crown (15). The crown (15) includes an outer plate (21) and an inner plate (23). The outer plate (21) and the inner plate (23) are opposed to each other with a gap provided therebetween. The outer plate (21) and the inner plate (23) are formed of a titanium alloy. The inner plate (23) has a projection (25). The upper end of the projection (25) abuts on the lower surface of the outer plate (21). The projection (25) and the outer plate (21) are bonded to each other by a spot welding method. The outer plate (21) and the inner plate (23) have thicknesses of 0.1 mm to 0.6 mm, respectively. The head (5) has a volume of 300 $cm^3$ or more. A portion between the outer plate (21) and the inner plate (23) maybe filled with a synthetic resin.

13 Claims, 5 Drawing Sheets

GOLF CLUB HEAD AND GOLF CLUB

This Non-provisional application claims priority under 35 U.S.C. §119(a) on Patent Application No(s). 2003-027430 filed in Japan on Feb. 4, 2003, the entire contents of which are hereby incorporated by reference.

BACKGROUND OF THE INVENTION

1. Field of the Invention

The present invention relates to a golf club. More particularly, the present invention relates to a hollow head of a golf club of a wood type.

2. Description of the Related Art

For a golf club of a wood type, a head formed of a persimmon has been mainly used. In some days, a head formed of a carbon fiber reinforced resin spread. In recent years, a head formed by a metal material such as stainless steel, an aluminum alloy or a titanium alloy has become mainstream. In particular, the titanium alloy having a high specific strength has been used willingly. In order to reduce weight, a hollow structure is employed for a head of a wood type which is formed of metal.

The swing form of an average golf player is unstable. Due to the disorder of the swing form, the hitting point (a contact point in a face with a golf ball) is apt to be shifted from a sweet spot. The shift of the hitting point causes a bad shot. In respect of the suppression of the bad shot, a head having a large volume has been proposed and employed. Referring to a large-sized head, an effort has been made to reduce the thickness of each member constituting the head in order to decrease the weight.

The face of the golf club head comprises a loft. By the loft, a golf ball hit by the golf club is launched obliquely and upward and flies with a backspin. A launch angle obtained immediately after hitting and a backspin rate are important elements that influence the trajectory of the golf ball. An appropriate trajectory height is obtained by a proper launch angle and backspin rate.

In the golf club of the wood type, importance is attached to a flight distance. In respect of the flight distance, the skilled in the art have recognized that a preferable golf club has a low initial backspin rate and a great launch angle. The skilled in the art have also recognized that a golf club having a smaller height of a center of gravity tends to have a lower initial backspin rate and a greater launch angle. A light crown is employed and most of weights are distributed close to the sole so that a golf club having a low center of gravity can be obtained.

Although the crown is thinned in order to lower the center of gravity, the rigidity and strength of the crown becomes insufficient due to the thinning. The insufficient rigidity excessively deforms a head at time of an impact. The excessive deformation deteriorates the resilience performance due to energy loss and changes the hitting sound. In particular, a large-sized head is formed from each member that is originally thinned. Therefore, further thinning causes the insufficiency of the rigidity to be remarkable.

Japanese Patent Publication No. 7-98076 has disclosed a golf club head in which a grain size in the metallographic structure of a crown is reduced. Although the strength of the crown is enhanced by the adjustment of the metallographic structure, an effect thereof has limitations. Only the adjustment of the metallographic structure cannot sufficiently meet a demand for reducing the weight of the crown.

Japanese Laid-Open Patent Publication No. 11-155981 has disclosed a head in which a dent is formed on a crown.

Although the rigidity of the crown is enhanced by the dent, an effect thereof has limitations. In addition, the dent remarkably deteriorates the appearance of the crown so that a sense of incompatibility is given to a golf player. Since golf is a mental sport, things to give the sense of incompatibility are kept at a distance by the golf player.

Japanese Utility Model Application No. 3063897 has disclosed a head in which a large number of ribs are formed on the crown. Although the rigidity of the crown is enhanced by the ribs, an effect thereof has limitations. In addition, a reduction in the weight of the crown reinforced by the ribs also has limitations.

SUMMARY OF THE INVENTION

The present invention has been made based on such a background. It is an object of the present invention to provide a golf club head of a wood type which is excellent in the rigidity of a crown.

In order to attain the object, a golf club head according to the present invention comprises a body, a face and a crown and is hollow. The crown includes an outer plate and an inner plate which are opposed to each other with a gap provided therebetween. The outer plate and the inner plate are partially bonded to each other in a plurality of portions. Since the gap is provided between the outer plate and the inner plate, the crown has a small weight. Since the outer plate and the inner plate are partially bonded to each other, the crown has a sufficient rigidity.

It is preferable that the outer plate and the inner plate should be formed of a titanium alloy. The titanium alloy has a great specific strength. By using the titanium alloy, therefore, a small weight and a high rigidity in the crown are more compatible with each other.

It is preferable that a portion between the outer plate and the inner plate should be filled with a synthetic resin. By filling with the synthetic resin, the rigidity of the crown can be more increased. In the case in which the outer plate and the inner plate are formed of a titanium alloy, the preferable thickness of each of the outer plate and the inner plate is 0.1 mm to 0.6 mm.

The crown having the outer plate and the inner plate is particularly suitable for a large-sized head, specifically, a head having a volume of 300 $cm^3$ or more.

The head according to the present invention is excellent in the rigidity of the crown. In this head, a light weight and a low center of gravity can be achieved. By employing this head, it is possible to obtain a golf club which is excellent in a flight distance.

DESCRIPTION OF THE PREFERRED EMBODIMENTS

The present invention will be described below in detail based on a preferred embodiment with reference to the drawings.

Figure 1:
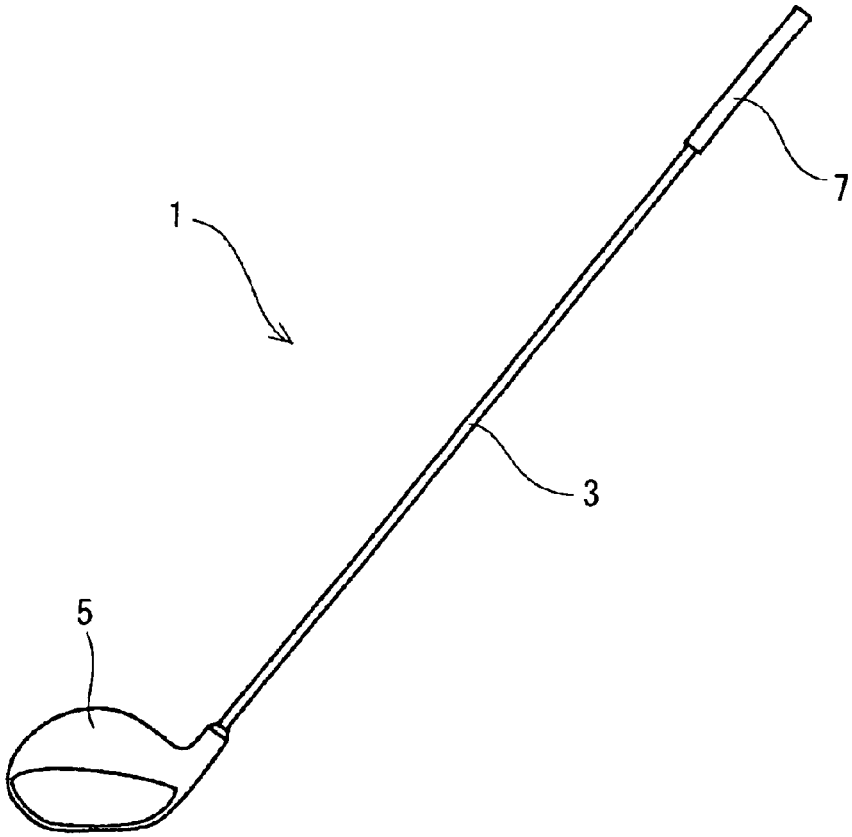
FIG. 1 is a perspective view showing a golf club according to an embodiment of the present invention.

A golf club 1 shown in FIG. 1 is of a wood type. The golf club 1 comprises a shaft 3, a head 5 and a grip 7. The head 5 is attached to the front end of the shaft 3. The rear end of the shaft 3 is fitted in the grip 7. Typically, the shaft 3 is formed of stainless steel or a fiber reinforced plastic. Typically, the grip 7 is formed of rubber, leather or artificial leather.

Figure 2:
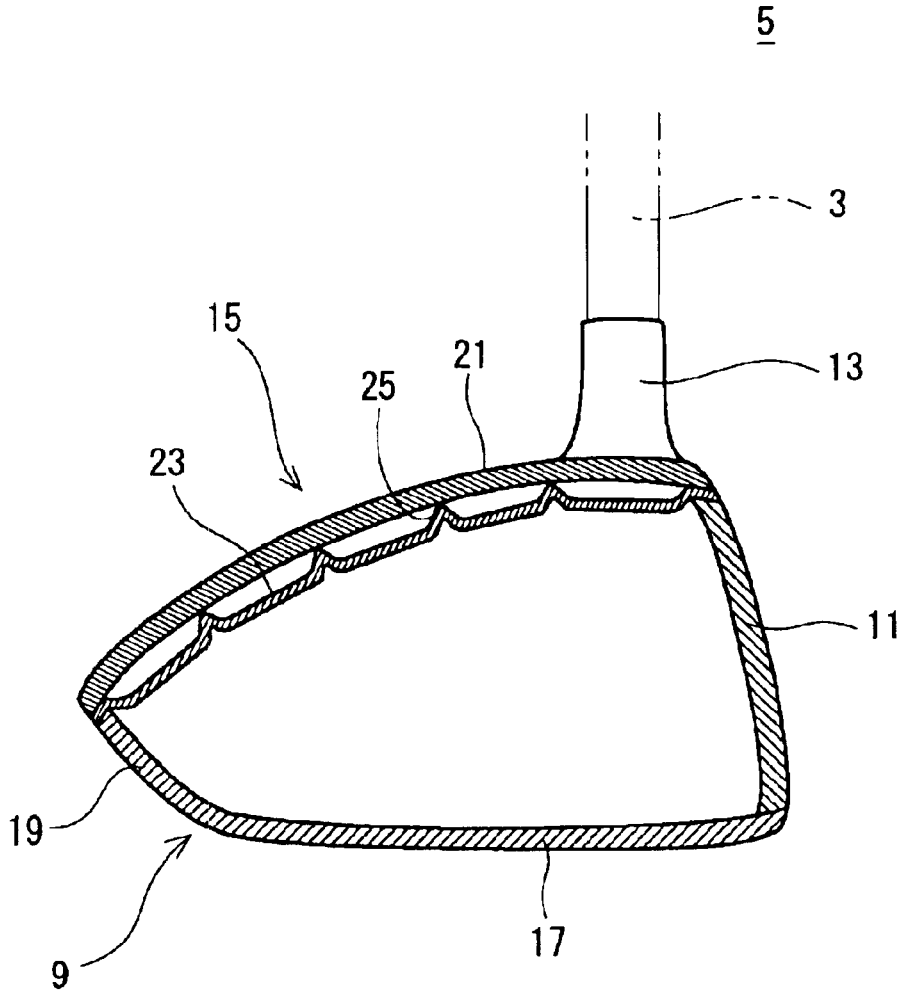
FIG. 2 is a sectional view showing the head of the golf club in FIG. 1.

As shown in FIG. 2, the head 5 is hollow. The head 5 includes a body 9, a face 11, a neck 13 and a crown 15. The front end of the shaft 3 is fitted in the neck 13. The crown 15 is bonded to the body 9. For the bonding, it is possible to employ a TIG welding method, a laser welding method, a brazing method or the like. The crown 15 may be bonded to the body 9 with an adhesive.

The head 5 shown in FIG. 2 has the neck 13 which is protruded upwardly on a part close to a sole of the crown 15. Instead of forming the above described neck 13 in which the front end of the shaft 3 is fitted, it is also possible that the crown 15 is arranged a hole on the part close to a sole and the shaft 3 is attached to the hole.

The front end is the end of the shaft 3 attached to the head 5. That is so-called tip end among persons skilled in the art. The rear end is the end of the shaft 3 attached to the grip 7 which is gripped by a golfer in hitting a golf ball. That is so-called butt end among persons skilled in the art.

The body 9 has a sole portion 17 and a side wall portion 19. The body 9 is formed by a metal material. Specific examples of the metal material include a titanium alloy, stainless steel and an aluminum alloy. Because of an excellent specific strength, the titanium alloy is preferable. A particularly preferable titanium alloy is 6Al-4V—Ti. The body 9 is usually formed by casting. The body 9 may be formed by forging.

The face 11 touches a golf ball. The face 11 has a loft. The face 11 is formed by a metal material. Specific examples of the metal material include a titanium alloy, stainless steel and an aluminum alloy. Because of an excellent specific strength, the titanium alloy is preferable. A particularly preferable titanium alloy includes Ti-4.5Al-3V-2Mo-2Fe and Ti-15V-6Cr-4Al. The face 11 is usually formed by the forging. The body 9 may be formed by the casting.

Figure 3:
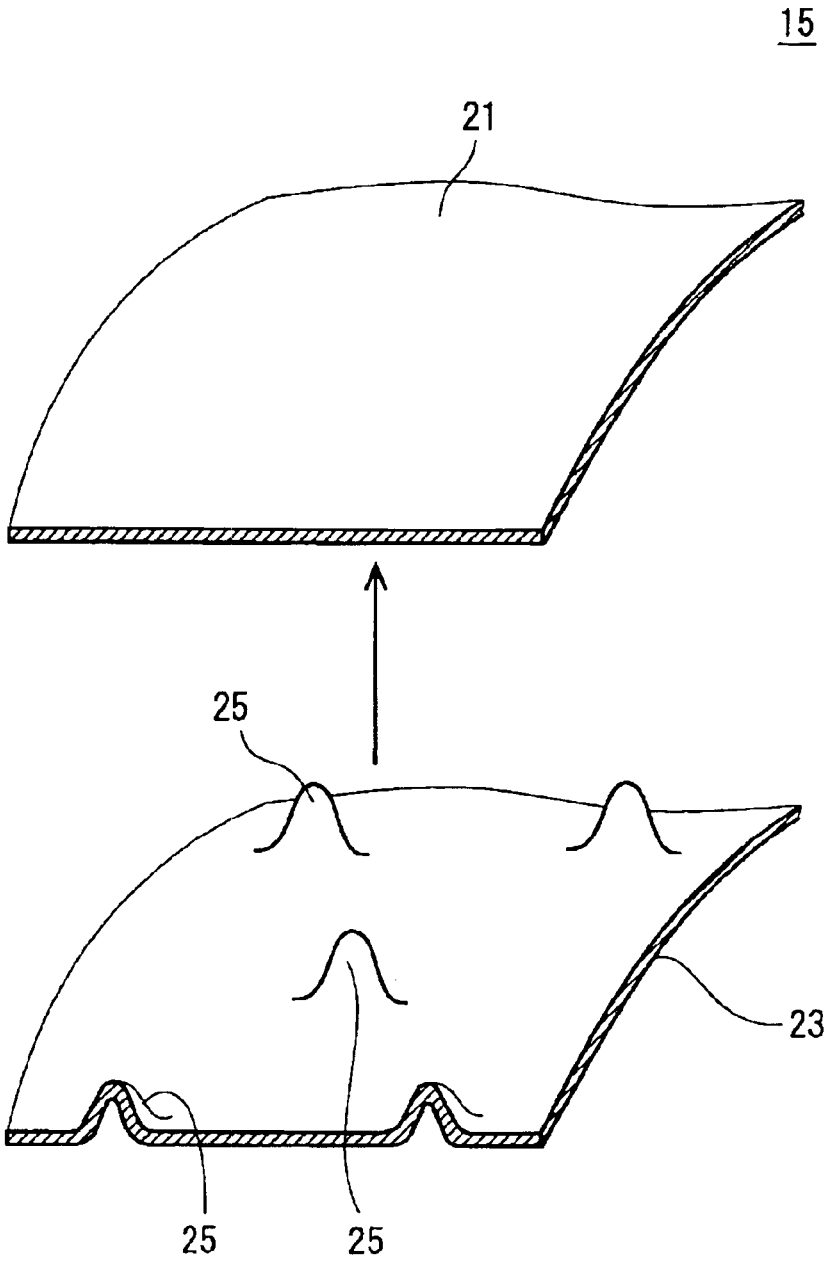
FIG. 3 is an enlarged exploded perspective view showing a part of the crown of the head in FIG. 2.

The crown 15 will be described below in detail with reference to FIGS. 2 and 3. The crown 15 includes an outer plate 21 and an inner plate 23. The outer plate 21 and the inner plate 23 are opposed to each other with a gap provided therebetween.

The outer plate 21 is curved. The contour of the upper surface of the head 5 is formed by the outer plate 21. The surface of the outer plate 21 is smooth. The head 5 has the same appearance as that of a conventional head 5. The head 5 does not give a sense of incompatibility to a golf player. The outer plate 21 is formed by a metal material. Specific examples of the metal material include a titanium alloy, stainless steel and an aluminum alloy. Because of an excellent specific strength, the titanium alloy is preferable. A particularly preferable titanium alloy is 6Al-4V—Ti.

The inner plate 23 is curved in the same manner as the outer plate 21. The inner plate 23 has a projection 25. The projection 25 substantially takes the shape of a truncated cone. The projection 25 is protruded toward an almost upper side (that is, the outer plate side). Examples of the material of the inner plate 23 include a titanium alloy, stainless steel, an aluminum alloy and a fiber reinforced resin. Because of an excellent specific strength, the titanium alloy is preferable. A particularly preferable titanium alloy is 6Al-4V—Ti.

In the case in which the inner plate 23 is formed by a metal material, the projection 25 is formed by carrying out a plastic processing such as punching over a base metal to be a flat plate. The upper end of the projection 25 abuts on the lower surface of the outer plate 21. The projection 25 and the outer plate 21 are bonded to each other. A spot welding method or the like can be employed for the bonding. By the bonding, the outer plate 21 and the inner plate 23 are firmly integrated with each other. In respect of firm integration and easiness of a processing, the number of the projections 25 is preferably four or more and more preferably nine or more. Moreover, the number of the projections 25 is preferably 100 or less and more preferably 40 or less.

Even if the outer plate 21 and the inner plate 23 are thin in the crown 15, a high rigidity can be obtained by the integration of the outer plate 21 and the inner plate 23. In the head 5, an energy loss is small at time of an impact. The head 5 is excellent in a resilience performance. Referring to the head 5, a golf player does not have a sense of incompatibility in a hitting sound.

In the crown 15, a high rigidity can be obtained by the integration of the outer plate 21 and the inner plate 23. Therefore, the total thickness of the outer plate 21 and the inner plate 23 can be reduced. In other words, the weight of the crown 15 can be reduced. By employing the light crown 15, it is possible to obtain the head 5 having a low center of gravity. The golf ball hit by the golf club 1 comprising the head 5 having a low center of gravity flies at a great launch angle and low backspin rate. The golf club 1 is excellent in a flight distance.

In the case in which the titanium alloy is employed, it is preferable that each of the outer plate 21 and the inner plate 23 should have a thickness of 0.1 mm to 0.6 mm. In some cases in which the thickness is less than the range, the rigidity of the crown 15 is insufficient. From this viewpoint, it is more preferable that the thickness should be 0.2 mm or more. In some cases in which the thickness is more than the range, the weight of the crown 15 is increased. From this viewpoint, the thickness is more preferably 0.5 mm or less and particularly preferably 0.4 mm or less.

In the case in which the titanium alloy is employed, it is preferable that the total thickness of the outer plate 21 and the inner plate 23 should be 0.2 mm to 1.0 mm. In some cases in which the total thickness is less than the range, the rigidity of the crown 15 is insufficient. From this viewpoint, the total thickness is more preferably 0.3 mm or more and particularly preferably 0.4 mm or more. In some cases in which the total thickness is more than the range, the weight of the crown 15 is increased. From this viewpoint, the total thickness is more preferably 0.7 mm or less and particularly preferably 0.6 mm or less.

The outer plate 21 and the inner plate 23 are integrated with each other by the projection 25 as described above. A gap is formed between the outer plate 21 and the inner plate 23 excluding the projection 25. The gap may be filled with a synthetic resin. By the filling, the rigidity of the crown 15 is enhanced. In respect of a reduction in the weight of the crown 15, a synthetic resin having a specific gravity of 1.5 or less is preferable. Examples of a suitable synthetic resin include an epoxy resin. The epoxy resin is excellent in a strength and a rigidity. The gap usually has a thickness of 0.4 mm to 1.5 mm.

The crown 15 is suitable for the large-sized head 5. A conventional crown is formed by a single plate. In respect of the suppression of an increase in a weight with an increase in a size, a thin plate is employed for the crown in the large-sized head. In the crown, a further reduction in the weight has limitations. By employing a two-layer structure of the outer plate 21 and the inner plate 23, it is also possible to further reduce the weight of the crown 15 in the large-sized head 5. More specifically, the crown 15 is suitable for the head 5 having a volume of 300 $cm^3$ or more, furthermore 350 $cm^3$ or more, and particularly 400 $cm^3$ or more.

Figure 4:
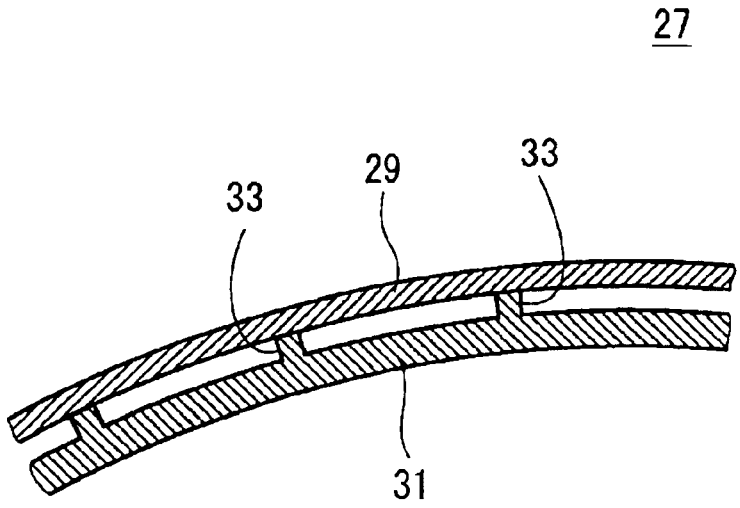
FIG. 4 is a sectional view showing a part of the crown of a golf club head according to another embodiment of the present invention.

As shown in FIG. 4, a crown 27 includes an outer plate 29 and an inner plate 31. The material and thickness of the outer plate 29 are equivalent to those of the outer plate 21 shown in FIGS. 2 and 3, respectively. The material and thickness of the inner plate 31 are equivalent to those of the inner plate 23 shown in FIGS. 2 and 3, respectively. The upper surface of the outer plate 29 is smooth.

The inner plate 31 has a column 33. The column 33 substantially takes the shape of a cylinder. The column 33 is protruded toward an almost upper side (that is, the outer plate side). The upper end of the column 33 abuts on the lower surface of the outer plate 29. The column 33 and the outer plate 29 are bonded to each other. A spot welding method or the like can be employed for the bonding. By the bonding, the outer plate 29 and the inner plate 33 are firmly integrated with each other. By the integration, the rigidity of the crown 27 is enhanced. The number of the columns 33 is preferably four or more and more preferably nine or more. Moreover, the number of the columns 33 is preferably 100 or less and more preferably 40 or less.

In respect of the rigidity of the crown 27, it is preferable that an area ratio of a portion provided with the column 33 to the whole upper surface of the inner plate 31 (a surface on the assumption that the column 33 is not formed) should be 2% to 30%. In some cases in which the area ratio is less than the range, the rigidity of the crown 27 is insufficient. From this viewpoint, it is more preferable that the area ratio should be 5% or more. In some cases in which the area ratio is more than the range, the weight of the crown 27 is excessively increased. From this viewpoint, it is more preferable that the area ratio should be 20% or less.

Figure 5:
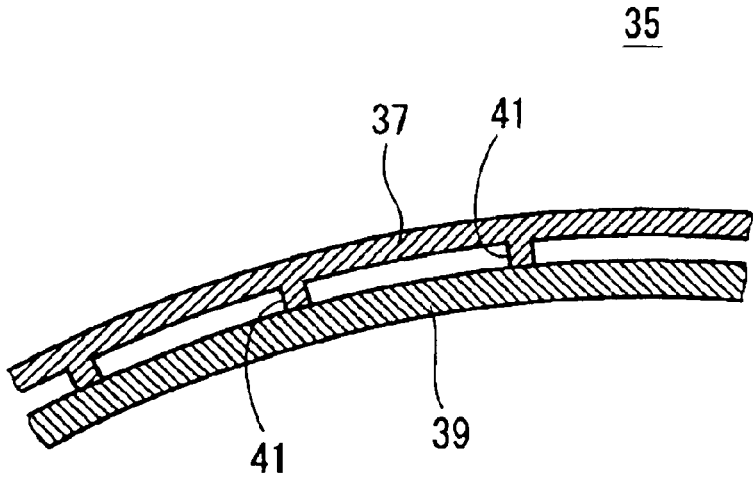
FIG. 5 is a sectional view showing a part of the crown of a golf club head according to a further embodiment of the present invention.

A crown 35 shown in FIG. 5 includes an outer plate 37 and an inner plate 39. The material and thickness of the outer plate 37 are equivalent to those of the outer plate 21 shown in FIGS. 2 and 3, respectively. The material and thickness of the inner plate 39 are equivalent to those of the inner plate 23 shown in FIGS. 2 and 3, respectively. The upper surface of the outer plate 37 is smooth.

The outer plate 37 has a column 41. The column 41 substantially takes the shape of a cylinder. The column 41 is protruded toward an almost lower side (that is, the inner plate side). The lower end of the column 41 abuts on the upper surface of the inner plate 39. The column 41 and the inner plate 39 are bonded to each other. A spot welding method or the like can be employed for the bonding. By the bonding, the outer plate 37 and the inner plate 39 are firmly integrated with each other. By the integration, the rigidity of the crown 35 is enhanced. The number of the columns 41 is preferably four or more and more preferably nine or more. Moreover, the number of the columns 41 is preferably 100 or less and more preferably 40 or less.

In respect of the rigidity of the crown 35, it is preferable that an area ratio of a portion provided with the column 41 to the whole lower surface of the outer plate 37 (a surface on the assumption that the column 41 is not formed) should be 2% to 30%. In some cases in which the area ratio is less than the range, the rigidity of the crown 35 is insufficient. From this viewpoint, it is more preferable that the area ratio should be 5% or more. In some cases in which the area ratio is more than the range, the weight of the crown 35 is excessively increased. From this viewpoint, it is more preferable that the area ratio should be 20% or less.

By a coupling portion taking a shape other than the shapes of a truncated cone and a cylinder, the outer plate and the inner plate may be integrated with each other. The coupling portion to be a separate member from the outer plate and the inner plate may be provided between the outer plate and the inner plate. A part of the crown may be constituted by the outer plate and the inner plate and other portions may be constituted by a single plate. The crown may be constituted by three plate members or more.

EXAMPLES

Example 1

A body formed of 6Al-4V—Ti was fabricated by a casting method and a face formed of Ti-15V-6Cr-4Al was fabricated by a forging method. An outer plate formed of 6Al-4V—Ti and having a thickness of 0.3 mm and an inner plate formed of 6Al-4V—Ti and having a thickness of 0.2 mm were prepared. A projection was formed on the inner plate, and the projection and the outer plate were bonded to each other by a spot welding method. Thus, a crown was fabricated. A gap between the outer plate and the inner plate is 0.7 mm. The body, the face and the crown were bonded to each other by a laser welding method and a hollow golf club head of a wood type was thus obtained. The head has a volume of 420 $cm^3$.

Example 2

A head according to an example 2 was obtained in the same manner as that in the example 1 except that a gap was set to be 1.2 mm and a volume was set to be 500 $cm^3$.

Example 3

A head according to an example 3 was obtained in the same manner as that in the example 1 except that the material of a face was Ti-4.5Al-3V-2Mo-2Fe, an inner plate had a thickness of 0.3 mm, a gap was set to be 0.5 mm, and bonding was carried out by a TIG welding method.

Example 4

A head according to an example 4 was obtained in the same manner as that in the example 1 except that the material of an inner plate was a carbon fiber reinforced resin, the thickness of the inner plate was set to be 0.5 mm, and a gap was filled with an epoxy resin, and a body and a crown were bonded to each other with an adhesive.

Comparative Example 1

A head according to a comparative example 1 was obtained in the same manner as that in the example 1 except that the material of a face was Ti-4.5Al-3V-2Mo-2Fe, an inner plate was not provided and bonding was carried out by a TIG welding method.

[Calculation of Geometrical Moment of Inertia]

There was supposed a vertical section which passes through a center in a transverse direction in FIG. 2 and is perpendicular to the paper of FIG. 2. A geometrical moment of inertia was calculated for 20 mm in the vicinity of the center of a crown on the vertical section. The geometrical moment of inertia is an index correlated with a face rigidity of the crown. The result is shown in the following Table 1.

[Measurement of Sweet Spot Height]

A head was set up onto a ground in such a manner that a lie angle and a hook angle have design values, and a height of a sweet spot (a projection point of a center of gravity of the head onto a face) from the ground was measured. The result is shown in the following Table 1.

[Measurement of Hitting Sound]

A shaft was attached to a head and a golf club was thus fabricated. The golf club was attached to a swing machine (manufactured by Golf Laboratories Co., Ltd.). The condition of the machine was set to have a head speed of 45 m/sec, and a golf ball (trade name of "XXIO TOUR SPECIAL regular spec" manufactured by Sumitomo Rubber Industries, Ltd.) was hit by setting the center of a face to be a hitting point. A hitting sound was taken in through a microphone (manufactured by Rion Co., Ltd.) placed in a position toward a toe side apart from a head position by 300 mm at time of an impact, and an A-type frequency correction was carried out by using a precision sound level meter (manufactured by Rion Co., Ltd.). The hitting sound was converted to an electric signal and the electric signal was then output to an FFT analyzer (trade name of "CF-6400" manufactured by Ono Sokki Co., Ltd.). By the FFT analyzer, the electric signal was subjected to an FFT processing and a time base sampling was carried out on the following conditions. Furthermore, a ⅓ OCT analysis was carried out to specify a frequency band to be a peak of the hitting sound, Analytical frequency: 0 to 16 kHz, Sampling number: 2048, Sampling time: a time immediately after an impact to a time that 48 ms passes after the impact, and Window processing: Hanning window.

Prior to the measurement, a calibration signal having a frequency of 250 Hz and a sound pressure of 124 dB was generated by a piston horn (manufactured by Brewer and Care Co., Ltd.) and the absolute sound pressures of a microphone and an FFT analyzer were calibrated.

[Hitting Test]

A shaft was attached to a head and a golf club was thus fabricated. The golf club was attached to a swing machine (manufactured by Golf Laboratories Co., Ltd.). The condition of the machine was set to have a head speed of 49 m/sec, a golf ball was hit and an initial backspin rate and a flight distance (a distance from a launch point to a stationary point) was measured. The result is shown in the Table 1.

TABLE 1

Result of Evaluation

| | Example 1 | Example 2 | Example 3 | Example 4 | Comparative Example 1 |
|---|---|---|---|---|---|
| Volume of head ($cm^3$) | 420 | 500 | 420 | 420 | 420 |
| Material of body | A | A | A | A | A |
| Body manufacturing method | Casting | Casting | Casting | Casting | Casting |
| Material of face | B | B | C | B | C |
| Face manufacturing method | Forging | Forging | Forging | Forging | Forging |
| Material of outer plate | A | A | A | A | A |
| Material of inner plate | A | A | A | D | — |
| Thickness of outer plate (mm) | 0.3 | 0.3 | 0.3 | 0.3 | 0.8 |
| Thickness of inner plate (mm) | 0.2 | 0.2 | 0.3 | 0.5 | — |
| Total thickness (mm) | 0.5 | 0.5 | 0.6 | 0.8 | 0.8 |
| Thickness of gap (mm) | 0.7 | 1.2 | 0.5 | 0.7 | — |
| Filling of gap | None | None | None | E | — |
| Body and crown bonding method | Laser welding | Laser welding | TIG welding | Adhesive | TIG welding |
| Geometrical moment of inertia | 0.1154 | 0.2654 | 0.1005 | 0.2527 | 0.0427 |
| Height of sweet spot on face surface (mm) | 2.4 | 2.5 | 3.2 | 0.8 | 4.0 |
| Main frequency band of hitting sound (KHz) | 5 | 6.3 | 5 | 4 | 4 |
| Backspin rate (rpm) | 2403 | 2392 | 2512 | 2180 | 2616 |
| Flight distance (m) | 234.3 | 236.9 | 232.5 | 236.5 | 228.8 |

A: 6Al-4V-Ti
B: Ti-15V-6Cr-4Al
C: Ti-4.5Al-3V-2Mo-2Fe
D: Carbon fiber reinforced plastic
E: Epoxy resin As shown in the Table 1, the head according to each example is excellent in a rigidity. In a golf club having the head attached thereto, a backspin can be suppressed because of a low sweet spot of the head. The golf club is excellent in a flight distance.

What is claimed is:

1. A hollow golf club head comprising a body, a face and a crown, wherein the crown includes an outer plate and an inner plate opposed to each other with a gap provided therebetween, the outer plate and the inner plate are partially bonded to each other in a plurality of portions, and wherein a portion between the outer plate and the inner plate is filled with a synthetic resin.

2. The golf club head according to claim 1, wherein the outer plate and the inner plate are formed of a titanium alloy.

3. The golf club head according to claim 2, wherein the outer plate and the inner plate have thicknesses of 0.1 mm to 0.6 mm, respectively.

4. The golf club head according to claim 1, wherein said golf club head has a volume of 300 $cm^3$ or more.

5. A golf club comprising a shaft, a hollow head attached to a front end of the shaft, and a grip in which a rear end of the shaft is fitted, wherein the head includes a body, a face and a crown, the crown has an outer plate and an inner plate opposed to each other with a gap provided therebetween, the outer plate and the inner plate are partially bonded to each other in a plurality of portions, and wherein a portion between the outer plate and the inner plate is filled with a synthetic resin.

6. A hollow golf club head comprising a body, a face and a crown, wherein the crown includes an outer plate and an inner plate opposed to each other with a gap provided therebetween, and the outer plate and the inner plate are partially bonded to each other in a plurality of portions defined by projections or columns extending from a surface of the inner plate.

7. A hollow golf club head comprising a body, a face and a crown, wherein the crown includes an outer plate and an inner plate opposed to each other with a gap provided therebetween, the outer plate and the inner plate are partially bonded to each other in a plurality of portions, and the outer plate is formed of a titanium alloy or a stainless steel.

8. A hollow golf club head comprising a body, a face and a crown, wherein the crown includes an outer plate and an inner plate opposed to each other with a gap provided therebetween, the outer plate and the inner plate are partially bonded to each other in a plurality of portions, and the inner plate is formed of a titanium alloy, a stainless steel or a fiber reinforced resin.

9. A hollow golf club head comprising a body, a face and a crown, wherein the crown includes an outer plate and an inner plate opposed to each other with a gap provided therebetween, the outer plate and the inner plate are partially bonded to each other in a plurality of portions, and the gap has no filling.

10. A golf club comprising a shaft, a hollow head attached to a front end of the shaft, and a grip in which a rear end of the shaft is fitted, wherein the head includes a body, a face and a crown, wherein the crown includes an outer plate and an inner plate opposed to each other with a gap provided therebetween, and the outer plate and the inner plate are partially bonded to each other in a plurality of portions defined by projections or columns extending from a surface of the inner plate.

11. A golf club comprising a shaft, a hollow head attached to a front end of the shaft, and a grip in which a rear end of the shaft is fitted, wherein the head includes a body, a face and a crown, wherein the crown includes an outer plate and an inner plate opposed to each other with a gap provided therebetween, the outer plate and the inner plate are partially bonded to each other in a plurality of portions, and the outer plate is formed of a titanium alloy or a stainless steel.

12. A golf club comprising a shaft, a hollow head attached to a front end of the shaft, and a grip in which a rear end of the shaft is fitted, wherein the head includes a body, a face and a crown, wherein the crown includes an outer plate and an inner plate opposed to each other with a gap provided therebetween, the outer plate and the inner plate are partially bonded to each other in a plurality of portions, and the inner plate is formed of a titanium alloy, a stainless steel or a fiber reinforced resin.

13. A golf club comprising a shaft, a hollow head attached to a front end of the shaft, and a grip in which a rear end of the shaft is fitted, wherein the head includes a body, a face and a crown, wherein the crown includes an outer plate and an inner plate opposed to each other with a gap provided therebetween, the outer plate and the inner plate are partially bonded to each other in a plurality of portions, and the gap has no filling.

* * * * *